US006941928B2

(12) United States Patent
Hartmann et al.

(10) Patent No.: US 6,941,928 B2
(45) Date of Patent: Sep. 13, 2005

(54) METHOD AND ARRANGEMENT FOR CONTROLLING THE DRIVE UNIT OF A VEHICLE

(75) Inventors: Dirk Hartmann, Stuttgart (DE); Holger Jessen, Ludwigsburg (DE); Nikolas Poertner, Detmold (DE)

(73) Assignee: Robert Bosch GmbH, Stuttgart (DE)

( * ) Notice: Subject to any disclaimer, the term of this patent is extended or adjusted under 35 U.S.C. 154(b) by 103 days.

(21) Appl. No.: 10/620,601

(22) Filed: Jul. 17, 2003

(65) Prior Publication Data

US 2005/0016498 A1 Jan. 27, 2005

(30) Foreign Application Priority Data

Jul. 17, 2002 (DE) ..... 102 32 354

(51) Int. Cl.[7] ..... F02D 45/00; B60K 26/00
(52) U.S. Cl. ..... 123/350; 123/406.23; 701/102
(58) Field of Search ..... 123/350–355, 123/361, 399, 406.12, 406.23; 701/102–104

(56) References Cited

U.S. PATENT DOCUMENTS

| | | | | | |
|---|---|---|---|---|---|
| 5,765,527 | A | * | 6/1998 | Lehner et al. | 123/339.1 |
| 6,000,376 | A | * | 12/1999 | Hess et al. | 123/406.23 |
| 6,131,546 | A | * | 10/2000 | Vogt et al. | 123/406.23 |
| 6,144,913 | A | * | 11/2000 | Braun et al. | 701/102 |
| 6,308,124 | B1 | * | 10/2001 | Kresse et al. | 701/53 |
| 6,398,692 | B1 | * | 6/2002 | Isaac | 477/107 |
| 6,786,197 | B2 | * | 9/2004 | Wild et al. | 123/350 |
| 6,842,686 | B2 | * | 1/2005 | Homeyer et al. | 701/84 |
| 2003/0187566 | A1 | * | 10/2003 | Hess et al. | 123/350 |
| 2004/0007205 | A1 | * | 1/2004 | Hartmann et al. | 123/319 |
| 2004/0107040 | A1 | * | 6/2004 | Edwards et al. | 701/110 |

* cited by examiner

*Primary Examiner*—Tony M. Argenbright
(74) *Attorney, Agent, or Firm*—Walter Ottesen

(57) ABSTRACT

A method and an arrangement for controlling the drive unit of a vehicle make possible a central coordination of various reserve torque requests. A reserve for an output quantity of the drive unit is formed. Various reserve requests of different physical significance can be compared to each other and a resulting reserve request is selected in dependence upon the comparison.

14 Claims, 2 Drawing Sheets

METHOD AND ARRANGEMENT FOR CONTROLLING THE DRIVE UNIT OF A VEHICLE

BACKGROUND OF THE INVENTION

In spark-ignition engines, it is known to obtain a steady state shift of the operating point by forming so-called reserve torques so that torque requests can be realized with the required dynamic. In this way, the desired value of an actuating quantity increases for a slow actuating path. The slow actuating path can be a charge path and the actuating variable can be the charge of the internal combustion engine. The increase of the desired value for the charge for forming a reserve torque is connected with a shift of the ignition angle in the retard direction in order to not influence the present torque of the drive unit of the vehicle and to activate the reserve torque with a high dynamic for a corresponding torque request so that the actual torque of the engine can essentially follow the desired torque with the requested dynamic. External torque requests such as torque losses because of external ancillary equipment and engine torque losses are viewed functionally separate from engine-internal torque requests such as those which arise when heating the catalytic converter.

SUMMARY OF THE INVENTION

Compared to the above, the method and arrangement of the invention for controlling the drive unit of a vehicle afford the advantage that various reserve requests of different physical significance are compared to each other and a resulting reserve request is formed in dependence upon this comparison. In this way, a central coordination of such different reserve requests is possible. This permits a central coordination of all external and internal torque requests which, for example, can originate from ancillary equipment and/or from the engine.

It is especially advantageous that the physical significance of the reserve requests is distinguished in dependence upon their realization by means of at least one actuating quantity. In this way, a simple classification of the different reserve requests is possible so that the central coordination of the reserve requests is facilitated.

It is also advantageous that the different reserve requests are limited in order to not influence an actual value of the output quantity. In this way, it is ensured that the driving performance is not affected with the realization of the resulting reserve request.

A further advantage is that the resulting reserve request is selected by means of a maximum selection from the different reserve requests. In this way, the central coordination of the different reserve requests can be realized especially simply and it is ensured that as many as possible or all different reserve requests can be realized.

A further advantage is that the resulting reserve request is realized by means of at least one actuating variable in dependence upon an activating signal. In this way, the central coordination of the different reserve requests and the formation of the resulting reserve request can be realized independently of the realization of the resulting reserve request.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
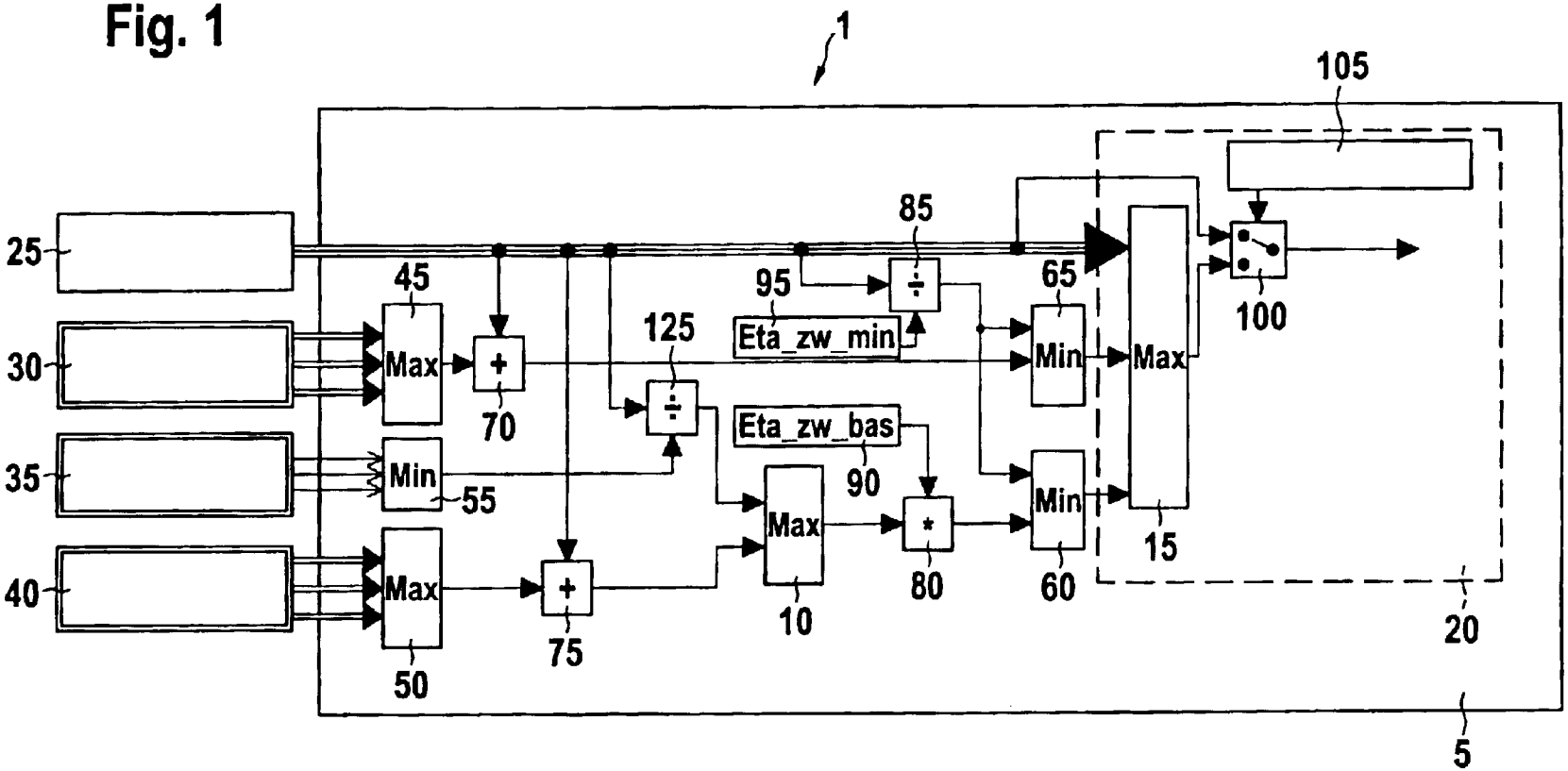
FIG. 1 is a schematic block diagram of an arrangement of the invention which also facilitates describing the method of the invention; and, FIG. 2 is a diagram showing the course of the ignition angle as a function of time.

In FIG. 1, reference numeral 1 identifies an arrangement for controlling the drive unit of a vehicle. In this example, the vehicle includes an internal combustion engine which is configured as a spark-ignition engine or diesel engine by way of example. In the following, it is assumed by way of example that the internal combustion engine is configured as a spark-ignition engine. An output quantity of the drive unit of the vehicle is, for example, the torque. The arrangement 1 can, for example, be integrated in an engine control of the internal combustion engine or can be configured as a separate control.

The driver of the vehicle can input a driver command torque by actuating an accelerator pedal. Additional torque requests can, for example, result from external interventions such as a drive slip control, an anti-blocking system or a driving dynamic control as well as from external consumers and/or ancillary equipment such as a climate-control compressor, an electric consumer or a servo motor. From the torque requests present, a desired torque is formed in a manner known per se in the engine control of the vehicle and, for example, is realized via a charge path of the engine with the charge of the cylinders as actuating quantity. The charge path is a slow actuating path compared to a crankshaft-synchronous path. The crankshaft-synchronous path includes an ignition angle path and/or a fuel path and likewise makes possible the realization of a torque request via a corresponding adjustment of the ignition angle and/or the injection quantity of the fuel and/or of the injection time. Torque requests can be realized more dynamically and more rapidly via the crankshaft-synchronous path than via the charge path.

In the following, it is assumed that the desired torque, which results from the individual torque requests, is realized via the charge path. In FIG. 1, reference numeral 25 identifies means which supplies this pregiven desired torque to the arrangement 1. The spark-ignition engine is viewed here by way of example and, as already described, it is advantageous with respect to this engine to obtain a steady state shift of the operating point of the engine by forming so-called reserve torques so that torque requests can be realized with the needed dynamic. To realize these reserve torques, the actuating quantity for the charge path, that is, the charge is increased at least in specific operating states of the engine such as the idle state or a near idle operating state or an operating state at low load. In order to not affect the actual torque of the drive unit by the realization of the reserve torques, the ignition angle, for example, can be correspondingly shifted in the retard direction. The reserve torques can then be called up as needed with high dynamic by shifting the ignition angle in the retard direction and can be applied to increase the desired torque. In this way, the actual torque of the drive unit can follow the desired torque with high dynamic in the described operating states.

According to the invention, the various reserve torque requests having different physical significance are compared to each other and a resulting reserve torque request is formed in dependence upon the comparison. In this way, the various reserve torque requests can be centrally coordinated. These reserve torque requests can likewise originate from external interventions (such as from a drive slip control, an anti-blocking system or a driving dynamic control), from external consumers (such as electric consumers and ancillary equipment such as a climate-control compressor or servo motors) or from the engine itself (such as from an idle control, a surge-damping control or from a heater of a catalytic converter).

Figure 2:
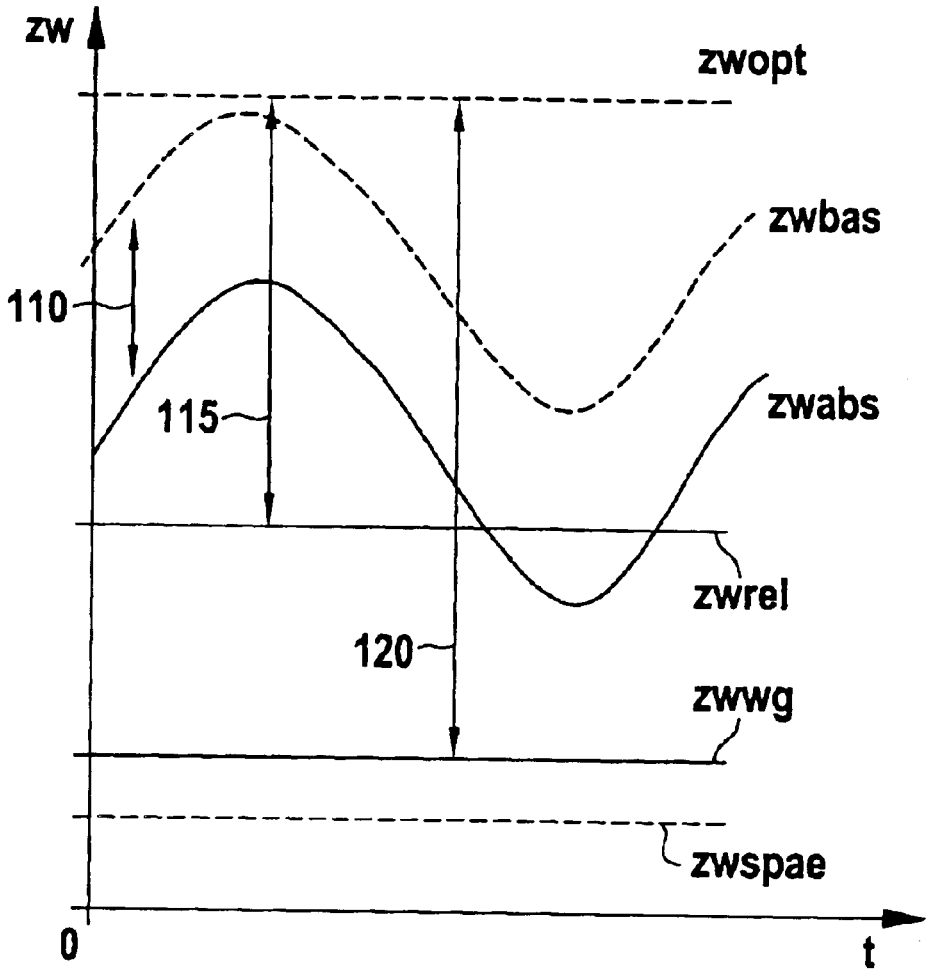

The various reserve torque requests can be distinguished or classified in accordance with their physical significance, for example, in dependence upon their realization by means of one or several actuating quantities. The ignition angle can, for example, be used as an actuating quantity. A first group of reserve torque requests is identified by reference numeral 30 in FIG. 1 and represents absolute reserve torque requests which follow the dynamic of a desired value for the ignition angle. This is shown in FIG. 2 wherein the ignition angle zw is plotted as a function of time (t). The course of the desired value for the ignition angle zw in FIG. 2 is identified by zwbas and, in this example, has an approximately sinusoidally-shaped trace. The ignition angle for realizing the absolute reserve torque request is then shifted relative to the desired value zwbas in a direction of a retarded ignition angle zwspae and follows the dynamic of the desired value zwbas, that is, likewise has an approximately sinusoidally-shaped trace and is identified by zwabs. The shift is identified in FIG. 2 by reference numeral 110 and is referred to hereinafter also as a first shift. A second group of reserve torque requests defines so-called relative reserve torque requests which are referred to an optimal value for the ignition angle zw and deviates therefrom in a steady manner. The optimal value for the ignition angle zw is identified in FIG. 2 by zwopt and is constant at the operating point in accordance with FIG. 2. The course of the ignition angle for the relative reserve torque requests deviates from this optimal value by a second shift 115 in a direction toward a retarded ignition angle zwspae and is identified in FIG. 2 by zwrel. The course zwrel of the ignition angle for the relative reserve torque requests is also constant in FIG. 2. In this way, a steady shift of the optimal operating point of the engine results for the relative reserve torque requests and this operating point is characterized by the optimal ignition angle zwopt in accordance with the second shift 115. A defined ignition angle for the relative reserve torque requests can be adjusted in this way with the ignition angle zwrel.

A third group of reserve torque requests results as a reserve torque in dependence upon at least one degree of efficiency of the drive unit, especially of a thermodynamic degree of efficiency of the engine or of the combustion. As also the relative reserve torque requests, the third group of reserve torque requests relates to the optimal ignition angle zwopt and, according to FIG. 2, likewise leads to a constant course identified by zwwg and is shifted relative to the optimal ignition angle zwopt by a third shift 120 in the direction toward the retarded ignition angle zwspae.

The retarded ignition angle zwspae can, for example, define a limit ignition angle with respect to the combustibility of the air/fuel mixture in the cylinder. A further shift of the ignition angle in the direction toward retard can no longer be compensated by a corresponding increase in charge and therefore acts directly on the actual torque of the drive unit. A retardation of the ignition angle beyond the later value zwspae should therefore be avoided when forming the reserve torque in order to not affect the driving performance of the vehicle. With the more retarded ignition angle zwspae, the various reserve requests are therefore limited with respect to their realization.

Accordingly, various reference points of the ignition angle result between the absolute reserve torque requests on the one hand and the relative reserve torque requests and the third group of reserve torque requests on the other hand. For the absolute reserve torque requests, the course of the desired value zwbas of the ignition angle is the reference point and, for the relative reserve torque requests and the third group of reserve torque requests, the reference point is the optimal ignition angle zwopt.

After the instantaneous desired torque of the arrangement 1 is supplied via the means 25 as described, means 30 are provided in accordance with FIG. 1 which supply various absolute reserve torque requests to the arrangement 1. Absolute reserve torque requests can, for example, originate from external consumers and/or from ancillary equipment having constant torque requests. External consumers are, for example, electric consumers such as an automobile radio, an electric sliding roof, et cetera and ancillary equipment can, for example, be a climate-control compressor, a servo motor, et cetera. The external consumers and/or the ancillary equipment define vehicle functions. The absolute reserve torque requests can also originate from engine functions such as the idle control.

The various absolute reserve torque requests of the vehicle functions and the engine functions are supplied to the arrangement 1 as respective Δ-torques and are compared to each other in a first maximum selection member 45. The maximum absolute reserve torque request is determined in the first maximum selection member 45. This reserve torque request is subsequently added to the desired torque in a first addition member 70. The desired torque is supplied to the arrangement 1 by the means 25 and is realized via the charge path. The output of the first addition member 70 then defines a first desired torque corrected by the maximum absolute reserve torque request and therefore contains the maximum absolute reserve torque request determined in the first maximum selection member 45 and coordinated therewith. As described, it is here noted that a torque request or a reserve torque request may only be presented in that amount for which the actual torque of the drive unit is not influenced. Accordingly, the first corrected torque, which is present at the output of the first addition member 70, is compared to the maximally adjustable absolute torque reserve in a third minimum selection member 65 without influencing the actual torque of the drive unit. This maximally adjustable absolute torque reserve results from the division of the desired torque, which is supplied by the means 25, by a minimum ignition angle efficiency Eta_zw_min by means of a first division member 85. A memory is assigned to the arrangement 1 and is not shown in FIG. 1. Respective minimum ignition angle efficiencies Eta_zw_min are assigned to different operating points and can be stored and used for the above-described division depending upon the instantaneous operating point. In the third minimum selection member 65, the minimum of the maximum adjustable absolute torque reserve and the output of the first addition member 70 is determined and transmitted to means 20 for the formation of a resulting reserve torque request. The particular minimum ignition angle efficiency Eta_zw_min is stored in a first memory 95 in accordance with FIG. 1.

The various relative reserve torque requests can come from the described vehicle functions and/or engine functions and are supplied by means 40 to the arrangement 1 in accordance with FIG. 1 and there be supplied to a second maximum selection member 50. The relative reserve torque requests are likewise supplied to the arrangement 1 as Δ-torque. An example of a relative reserve torque request of an engine function is a relative reserve torque request from the idle control which requests a certain actuating range in order to be able to realize increased torque interventions with a requested dynamic. In the second maximum selection member 50, the maximum relative reserve torque request is determined and is transmitted further to a second addition member 75 for addition to the desired torque supplied by the means 25. A second additively corrected desired torque results at the output of the second addition member 75. This desired torque contains the maximum relative reserve torque request coordinated by means of the second maximum selection member 50 in the manner described.

The various thermodynamic requests of efficiency imposed on the engine are supplied to the arrangement 1 by the means 35 in accordance with FIG. 1 and are there coordinated in a first minimum selection member 55. The efficiency requests require a thermodynamic efficiency of the combustion as described. In the first minimum selection member 55, the request with the lowest efficiency to be adjusted is selected from the various supplied thermodynamic efficiency requests, that is, the minimum thermodynamic efficiency request is selected. This minimum thermodynamic efficiency request is supplied to a second division member 125. In the second division member 125, the desired torque, which is supplied by the means 25, is divided by the minimum thermodynamic efficiency request. In this way, a third corrected desired torque results at the output of the second division member 125. An example for a thermodynamic efficiency request is the efficiency request for heating a catalytic converter because of a thermodynamically deteriorated efficiency of the combustion in the engine.

The second corrected desired torque having the maximum relative reserve request and the third corrected desired torque both effect a shift of the operating point of the engine referred to the optimal ignition angle zwopt of FIG. 2 while considering the minimum thermodynamic efficiency request. The second corrected desired torque and the third corrected desired torque are supplied to a third maximum selection member 10 and are there compared to each other. With this coordination, the greater of the two corrected desired torques is selected and multiplied by a base ignition angle efficiency Eta_zw_bas in a multiplication member 80. In this way, the reference to the optimal ignition angle zwopt is established because the multiplication by the base ignition angle efficiency Eta_zw_bas effects the second shift 115 or the third shift 120 depending upon which of the two corrected desired torques was selected in the third maximum selection member 10. According to FIG. 2, it is the third corrected desired torque which is realized because the third shift 120 is greater than the second shift 115 and therefore a higher reserve torque request is realized.

The base ignition angle efficiency Eta_zw_bas is stored in a second memory 90 in accordance with FIG. 1. For the base ignition angle efficiency Eta_zw_bas it can also be provided that various base ignition angle efficiencies Eta_zw_bas are stored in the second memory 90 for various operating points of the engine and that, depending upon the instantaneous operating point of the engine, the corresponding base ignition angle efficiency Eta_zw_bas is selected from the second memory 90 for multiplication in the multiplication member 80. As already described, a torque request may be made only to the extent to which the actual torque of the drive unit is not influenced. For this reason, the output of the multiplication member 80 is compared in a second minimum selection member 60 to the output of the first division member 85 and therefore the maximum adjustable absolute torque reserve. In the second minimum selection member 60, the minimum is selected from the maximum adjustable absolute torque reserve and the output of the multiplication member 80 and is likewise supplied to the means 20.

The means 20 includes a fourth maximum selection member 15 to which the output of the third minimum selection member 65 and the output of the second minimum selection member 60 are supplied. In addition, the desired value, which is supplied by the means 25, is supplied to the fourth maximum selection member 15. This desired torque is realized via the charge path. In this way, in the fourth maximum selection member 15, the maximum of the following is determined: the desired value supplied by the means 25; the minimum of the maximum adjustable absolute torque reserve and the first corrected desired torque as output of the first addition member 70; and, the minimum of the maximum adjustable absolute torque reserve and the output of the multiplication member 80. This maximum is that resulting desired torque which is realized via the charge path and leads to a corresponding adjustment of the ignition angle. If the resulting desired torque is not equal to the desired torque supplied by the means 25, the resulting desired torque is a corrected desired torque which contains a resulting reserve torque request based on the previously described coordinations of the maximum selection members (45, 50, 10, 15) and the minimum selection members (55, 60, 65). Furthermore, the means 20 includes a switch 100 which is driven by an activation signal 105. Via the switch 100, either the desired torque, which is supplied by the means 25, or the resulting desired torque, which is supplied from the fourth maximum selection member 15, can be selected for realization via the charge path. The resulting desired torque is selected as output of the fourth maximum selection member 15 by switch 100 when the activation signal 105 is set based on an active reserve torque request. If no active reserve torque request is present, then the activation signal 105 is reset and the switch 100 selects the desired torque, which is supplied by the means 25, for realization via the charge path.

The realization of the desired torque or the resulting desired torque selected by the switch 100 then takes place via the engine control.

In the following, the method of the invention will be again explained based on a numerical example. It is assumed by way of example that the means 25 conducts a desired torque of 35 Nm to the arrangement 1. The instantaneous base ignition angle efficiency Eta_zw_bas in the instantaneous operating point of the engine in this case is 96% referred to the thermodynamic optimal efficiency for an optimal ignition angle at 100%.

The coordinated absolute reserve torque requests, that is, the maximum absolute reserve torque request, should, in this example, be 10 Nm. The coordinated relative torque requests (that is, the maximum relative reserve torque request) should be 5 Nm in this example. The requested coordinated thermodynamic efficiency (that is, the minimum thermodynamic efficiency) should, in this example, be 50%. In this way, a value of 45 Nm results as a first corrected desired torque at the output of the first addition member 70. For the second corrected desired torque (that is, the output of the second addition member 75), a value of 40 Nm results. For the third corrected desired torque at the output of the second division member 125, a value of 70 Nm results. In this way, and after considering the base ignition angle efficiency Eta_zw_bas at the output of the multiplication member 80, a value of 67 Nm results for a fourth corrected desired torque which is formed from the various relative reserve torque requests and the various thermodynamic efficiency requests after coordination and with reference to the optimal ignition angle zwopt. If the minimum ignition angle efficiency Eta_zw_min is, for example, 40%, then the maximally adjustable absolute torque reserve on the charge path or the maximum desired torque adjustable via the charge path is 87 Nm. Since this value is greater than all corrected desired torques, all reserve torque requests can accordingly be satisfied while maintaining a constant actual torque of the drive unit without the driving performance of the vehicle being affected. The value of 67 Nm is selected in the fourth maximum selection member 15 as a resulting desired torque. If, in contrast, the minimum ignition angle efficiency Eta_zw_min is, for example, only 65%, then the maximum adjustable absolute torque reserve or the maximum desired torque, which can be realized via the charge path, is equal to 54 Nm. The thermodynamic efficiency request can thereby be satisfied only up to the minimum ignition angle efficiency Eta_zw_min, that is, up to a fourth corrected desired value of 54 Nm.

In this example, the ignition angle was selected as the actuating quantity for the reserve torque requests. However, another actuating quantity can also be selected, for example, the fuel injection quantity and/or the injection time. Furthermore, and in this example, the torque was selected as the output quantity of the drive unit. However, any other output quantity of the drive unit can be selected for realizing the method of the invention and the arrangement of the invention, for example, the power outputted by the drive unit or any desired quantity derived from the torque.

It is understood that the foregoing description is that of the preferred embodiments of the invention and that various changes and modifications may be made thereto without departing from the spirit and scope of the invention as defined in the appended claims.

What is claimed is:

1. A method for controlling the drive unit of a vehicle, the method comprising the steps of:

forming a reserve for an output quantity of said drive unit;

comparing various reserve requests of different physical significance to each other; and, forming a resulting reserve request in dependence upon the comparison.

2. The method of claim 1, comprising the further step of distinguishing the physical significance of the reserve requests in dependence upon a realization of said reserve requests by at least one actuating quantity.

3. The method of claim 2, wherein absolute reserve requests follow the dynamic of a desired value for said at least one actuating quantity.

4. The method of claim 3, wherein relative reserve requests are referred to an optimal value for said at least one actuating quantity and deviate from said optimal value in a steady manner.

5. The method of claim 4, wherein a group of reserve requests form a reserve in dependence upon an efficiency of said drive unit.

6. The method of claim 5, wherein said group of reserve requests is referred to said optimal value for said at least one actuating quantity.

7. The method of claim 4, wherein said drive unit is an internal combustion engine; and, a group of reserve requests form a reserve in dependence upon a thermodynamic efficiency of said internal combustion engine.

8. The method of claim 7, wherein said group of reserve requests is referred to said optimal value for said at least one actuating quantity.

9. The method of claim 1, comprising the further step of limiting said various reserve requests in order to not influence an actual value of said output quantity.

10. The method of claim 1, comprising the further step of selecting the resulting reserve request with a maximum selection from various reserve requests.

11. The method of claim 1, comprising the further step of realizing the resulting reserve request with said at least one actuating quantity in dependence upon an activating signal.

12. The method of claim 1, comprising the further step of selecting an ignition angle as said at least one actuating quantity.

13. The method of claim 1, comprising the further step of selecting a torque as said output quantity.

14. An arrangement for controlling the drive unit of a vehicle, the arrangement comprising:

means for forming a reserve for an output quantity of said drive unit;

means for comparing various reserve requests of different physical significance to each other; and, means for forming a resulting reserve request in dependence upon the comparison.

* * * * *